US010272006B2

(12) United States Patent
Tamai et al.

(10) Patent No.: US 10,272,006 B2
(45) Date of Patent: Apr. 30, 2019

(54) CARE METHOD AND CARE ROBOT USED THEREIN

(71) Applicant: MUSCLE CORPORATION, Osaka-shi, Osaka (JP)

(72) Inventors: Hirofumi Tamai, Osaka (JP); Satoshi Tamai, Osaka (JP)

(73) Assignee: MUSCLE CORPORATION, Osaka (JP)

( * ) Notice: Subject to any disclaimer, the term of this patent is extended or adjusted under 35 U.S.C. 154(b) by 0 days.

(21) Appl. No.: 14/642,136

(22) Filed: Mar. 9, 2015

(65) Prior Publication Data

US 2015/0173988 A1 Jun. 25, 2015

Related U.S. Application Data

(63) Continuation of application No. PCT/JP2013/075960, filed on Sep. 17, 2013.

(30) Foreign Application Priority Data

Sep. 19, 2012 (JP) ..... 2012-206385
Sep. 19, 2012 (JP) ..... 2012-206401

(51) Int. Cl.
*A61G 7/10* (2006.01)

(52) U.S. Cl.
CPC ..... *A61G 7/1046* (2013.01); *A61G 7/1019* (2013.01); *A61G 7/1025* (2013.01);
(Continued)

(58) Field of Classification Search
CPC .. A61G 7/1046; A61G 7/1025; A61G 7/1036; A61G 7/1057; A61G 2203/22;
(Continued)

(56) References Cited

U.S. PATENT DOCUMENTS

2005/0135907 A1* 6/2005 Romano ..... A61G 7/1011 414/401
2007/0000049 A1* 1/2007 White ..... A61G 7/1015 5/84.1
2010/0115695 A1* 5/2010 White ..... A61G 7/1015 5/81.1 R

FOREIGN PATENT DOCUMENTS

JP 2002-136549 A 5/2002
JP 2002-253623 A 9/2002
(Continued)

OTHER PUBLICATIONS

Daniel Oandasan, How to Use Hoyer Lift, Youtube, Uploaded Apr. 28, 2011.*
(Continued)

*Primary Examiner* — Abby Y Lin
(74) *Attorney, Agent, or Firm* — Lucas & Mercanti, LLP

(57) ABSTRACT

A care method and a care robot that can simplify care and reduce the burden on a caregiver, in particular the burden on the caregiver during the transfer of a care receiver. A sheet is spread out on top of a bed, and the care receiver is laid on the sheet. The sheet is formed so that both ends thereof have parts to be held that are held by arms of a robot. The robot and the arms are positioned relative to the care receiver, and the robot is moved towards the bed so that the arms hold the parts to be held. The arms are raised by a predetermined distance, and when the arms are in the raised state, the robot is moved away from the bed.

1 Claim, 18 Drawing Sheets

(52) U.S. Cl.
CPC ..... *A61G 7/1036* (2013.01); *A61G 7/1057* (2013.01); *A61G 2203/22* (2013.01)

(58) Field of Classification Search
CPC ..... A61G 7/10; A61G 7/1019; A61G 7/1026; A61G 7/1038; B25J 13/00; B25J 13/02–13/065
See application file for complete search history.

(56) References Cited

FOREIGN PATENT DOCUMENTS

| | | | |
|---|---|---|---|
| JP | 2010-029420 | A | 2/2010 |
| JP | 2011-172898 | A | 9/2011 |
| WO | WO 2009-147832 | A1 | 12/2009 |

OTHER PUBLICATIONS

PHC, Nova—Medium Hammock Style Sling, Feb. 16, 2009 courtesy of Internet Archive Wayback Machine.*
David Boroff, King orders 1345 pound man to be airlifted from home, New York Daily News, Aug. 20, 2013.*
Ueda Nobuo et all, JP 2011172898 Google english translation, 2011.*
PCT International Search Report dated Jan. 14, 2014, which was issued in a related PCT International Application No. PCT/JP2013/075960, along with English translation (5 pages).

* cited by examiner

CARE METHOD AND CARE ROBOT USED THEREIN

CROSS REFERENCE TO RELATED APPLICATION

This application is a Continuation of PCT International Patent Application No. PCT/JP2013/075960 filed on Sep. 17, 2013, which claims the benefit of Japanese Patent Application Nos. 2012-206385 filed Sep. 19, 2012 and 2012-206401 filed Sep. 19, 2012, the entire disclosure of each of which is incorporated herein by reference in its entirety.

FIELD OF THE INVENTION

The present invention is related to a care method and a care-robot used therein. More specifically, the invention is related to the care method and the care-robot used therein to reduce the burden on health care workers such as care helpers (hereinafter, referred to as caregivers) and old people and physically handicapped people (hereinafter, referred to as care receivers).

BACKGROUND INFORMATION

Often, caregivers support care receivers' lives. While attending to the needs of the care receivers, the caregivers have to move the care receivers from beds to wheelchairs and vice versa, for example for the care receivers to go to a restroom or to take a bath.

Usually, one caregiver has to move a care receiver alone. This is hard work for the caregiver. Therefore, most caregivers suffer from lower back pain. Such lower back pain has been one of the occupational disorders for the caregivers.

In order to solve this problem, people in the field of providing care to others desire a care method and a care-robot used therein to reduce the burden on the caregivers. Especially, a care method and a care-robot used therein to reduce the burden on the caregivers to move the care receivers from beds to wheelchairs and vice versa.

JP 2002-136549 discloses a carrier for nursing care. However, the carrier has a complex construction, and thus the carrier cannot be handled easily.

SUMMARY

Considering the problem of the prior art, the present invention provides a care method and a care-robot used therein to reduce the burden on caregivers, especially, to reduce the burden when moving the care receivers.

The care method of the present invention includes: a step of spreading out a sheet on top of a bed, in which the sheet has holding parts for arms of a robot at both sides of the sheet; a step of laying a care receiver on the sheet; a step of positioning a robot and arms thereof relative to the care receiver; a step of moving the robot towards the bed and holding the holding parts of the sheet by the arms; a step of moving the arms upward by a predetermined distance; and a step of moving the robot away from the bed after the step of moving the arms upward.

The care method of the present invention preferably includes a step of positioning the head level of the care receiver higher than the foot level thereof.

In a first embodiment, the care-robot of the present invention includes a movable base, a first rising and falling shaft and a second rising and falling shaft arranged on the base, and a U-formed element. The first rising and falling shaft has a rotative element being able to rotatively and unslidably hold the bottom section of the U-formed element, and the second rising and falling shaft has a rotative element being able to rotatively and slidably hold the bottom section of the U-formed element. One part of the bottom section of the U-formed element is rotatively and unslidably held by the first rising and falling shaft, and another part of the bottom section of the U-formed element is rotatively and slidably held by the second rising and falling shaft.

In this embodiment of the care-robot of the present invention, it is preferable that a first power source for the first rising and falling shaft is arranged on the base, and a second power source for the second rising and falling shaft is arranged on the base.

Also, in the first embodiment of the care-robot of the present invention, it is preferable that the base contains a control panel controlling the first rising and falling shaft and the second rising and falling shaft. In this case, it is more preferable that the control panel is arranged between and rearward of the first rising and falling shaft and the second rising and falling shaft.

In a second embodiment, the care-robot of the present invention includes a movable base, a rising and falling shaft arranged on the base, a rotative shaft attached to the rising and falling shaft, a first expanding and contracting shaft and a second expanding and contracting shaft arranged symmetrically with respect to the rotative shaft, a first arm arranged to the first expanding and contracting shaft and a second arm arranged to the second expanding and contracting shaft.

In the second embodiment of the care-robot of the present invention, it is preferable that the care robot has a control panel with a manual operating means and a control device. The control device includes a position-force control changing means changing between position control and force control, a rising and falling shaft drive controlling means controlling drive of the rising and falling shaft, a rotative shaft drive controlling means controlling drive of the rotative shaft, a first expanding and contracting shaft drive controlling means controlling drive of the first expanding and contracting shaft, and a second expanding and contracting shaft drive controlling means controlling drive of the second expanding and contracting shaft. In this case, it is more preferable that the control panel additionally has a robot start-stop button, and the control device additionally has a supervisor means supervising the position-force control changing means changing between position control and force control, wherein the rising and falling shaft drive controlling means controls the drive of the rising and falling shaft, the rotative shaft drive controls the means controlling drive of the rotative shaft, the first expanding and contracting shaft drive controls the means controlling drive of the first expanding and contracting shaft, and the second expanding and contracting shaft drive controlling means controlling drive of the second expanding and contracting. The supervisor means supervises the position-force control changing means in response to signals from the robot start-stop button. Also, it is more preferable that the control panel additionally has a head side indicating means indicating whether the head of the care receiver is on the right-side of the care robot or the left-side thereof. The rotative shaft drive controlling means additionally has a rotative angle limiting means which limits the rotative angle so that the head of the care receiver is not positioned below the level surface in response to a signal from the head side indication means. Also, it is more preferable that the control panel additionally has a manual-automatic operation changing means and an action pattern selecting means, and that the control device has a memory for storing action patterns.

In the second embodiment of the care-robot of the present invention, it is also preferable that the first arm and the second arm have the shape of a stick.

In the second embodiment of the care-robot of the present invention, it is also preferable that the care-robot has a power source for driving.

In the second embodiment of the care-robot of the present invention, it is also preferable that the care-robot is covered with a decorative cover.

In the second embodiment of the care-robot of the present invention, it is also preferable that the base has a moving device; wherein the moving device has a front wheel holding block having a front level part and an upslope rear part.

Embodiments of the present invention are constructed as mentioned above, so that it is not necessary for a caregiver to lift up a care receiver from a bed when moving a care receiver from a bed to a wheelchair and the like. As a result, the burden on caregivers is reduced.

BRIEF DESCRIPTION OF THE DRAWINGS

FIG. 5(*a*) shows a fixed part and (b) shows a sliding part.

FIG. 5(*b*) is a schematic drawing of a holding part for a U-formed element showing a sliding part.

FIG. 7(*b*) is a sectional view of a custom care sheet.

DETAILED DESCRIPTION

Hereinafter, by referring to the attached drawings, embodiments of the present invention are described. However, the present is not intended to be limited to the embodiments shown and described.

Outline

The care method of the present invention is to assist in moving care receivers from beds to wheelchairs by care-robots in accordance with the following procedures. Namely, the care method of the present invention is to assist care receivers by transfer assist robots (care-robots) when the care receivers are moved to wheelchairs and the like. The following steps are carried out by caregivers.

Figure 1:
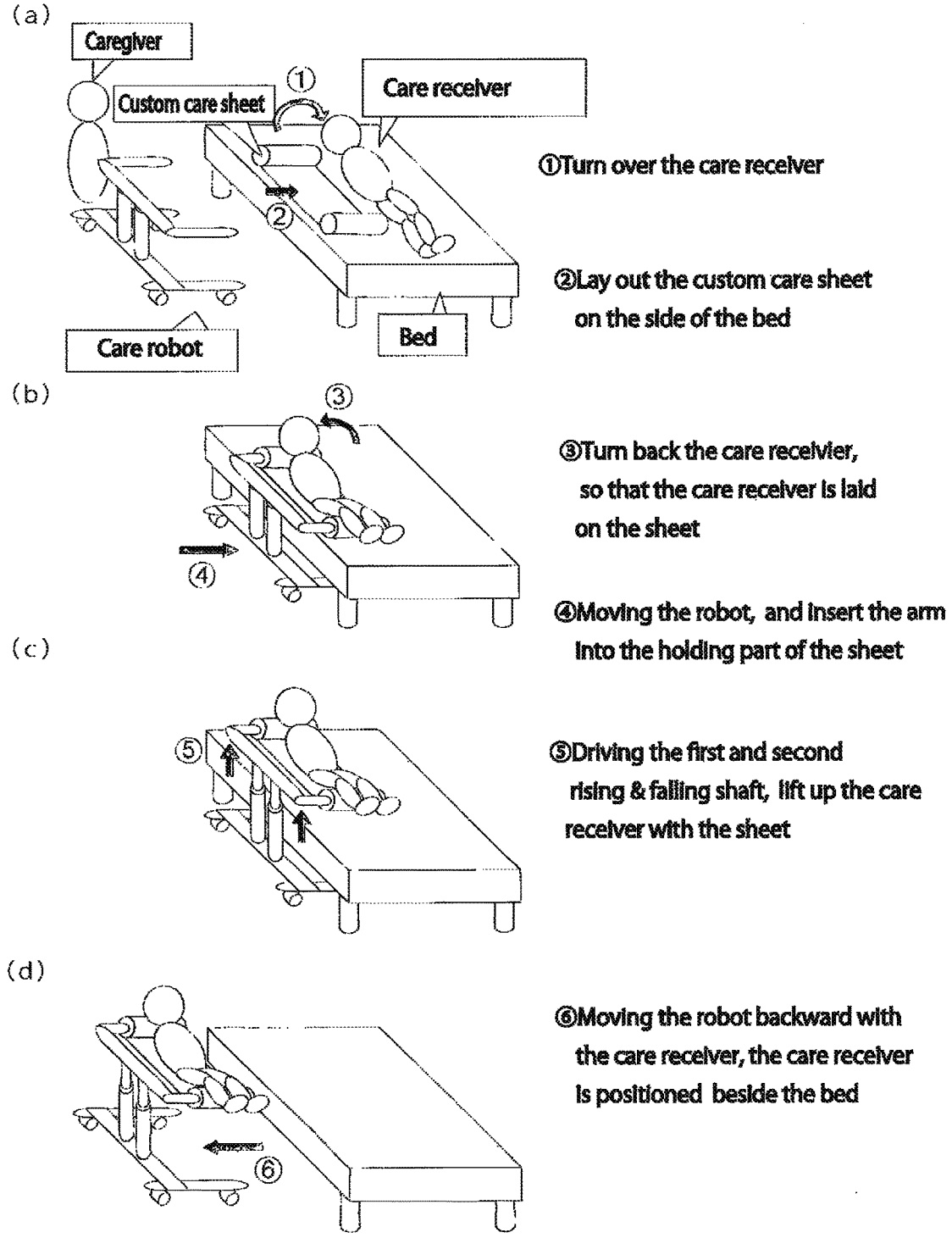
FIG. 1 is a schematic drawing showing care procedures by a care method of the present invention.

Step 1: Positioning the care receiver lying on the bed so that his back faces the approaching way of the transfer assist robot (hereinafter, referred to as robot), and more specifically, turning over the care receiver by about 90 degrees, and then spreading out a custom care sheet on the robot approaching side of the bed (Refer to FIG. 1(*a*)).

Step 2: After turning over the care receiver back by about 90 degrees so as for the care receiver to be laid down on the custom care sheet, moving the robot towards the bed and entering the robot into the bed area, in which the arms of the robot hold the custom care sheet (Refer to FIG. 1(*b*)).

Step 3: Lifting the custom care sheet above the bed. Namely, the care receiver is raised above the bed (Refer to FIG. 1(*c*)).

Step 4: Moving the care receiver away from the bed by moving the robot backward (Refer to FIG. 1(*d*)).

Accordingly, by the above mentioned procedures, the burden on caregivers is reduced when moving the care receivers from a bed to a wheelchair and vice versa.

Hereinafter, referring to the drawings, the mechanism of the robot is described.

Embodiment 1

As shown in FIG. 1 to FIG. 5, the robot R is mainly equipped with a movable base B which moves forward and backward, a first rising and falling shaft 1 arranged on the base B, a second rising and falling shaft 2 arranged on the base B at a predetermined distance from the first rising and falling shaft 1, a main rotative block 3 attached to the top of the first rising and falling shaft 1, a subordinate rotative block 4 attached to the top of the second rising and falling shaft 2, a U-formed element 5 unslidably held by the main rotative block 3 and slidably held by the subordinate rotative block 4, a driving power source 6, and a control panel 10.

Figure 2:
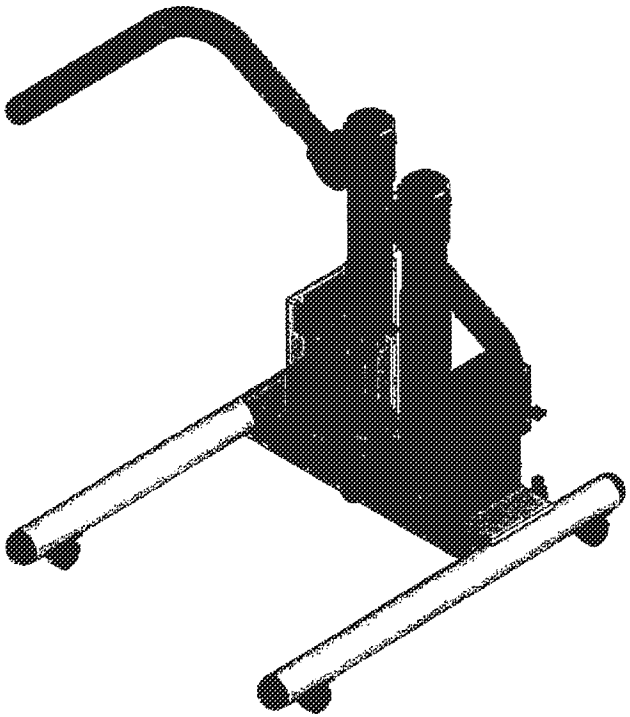
FIG. 2 is a perspective view of the first embodiment of the care-robot of the present invention.
Figure 3:
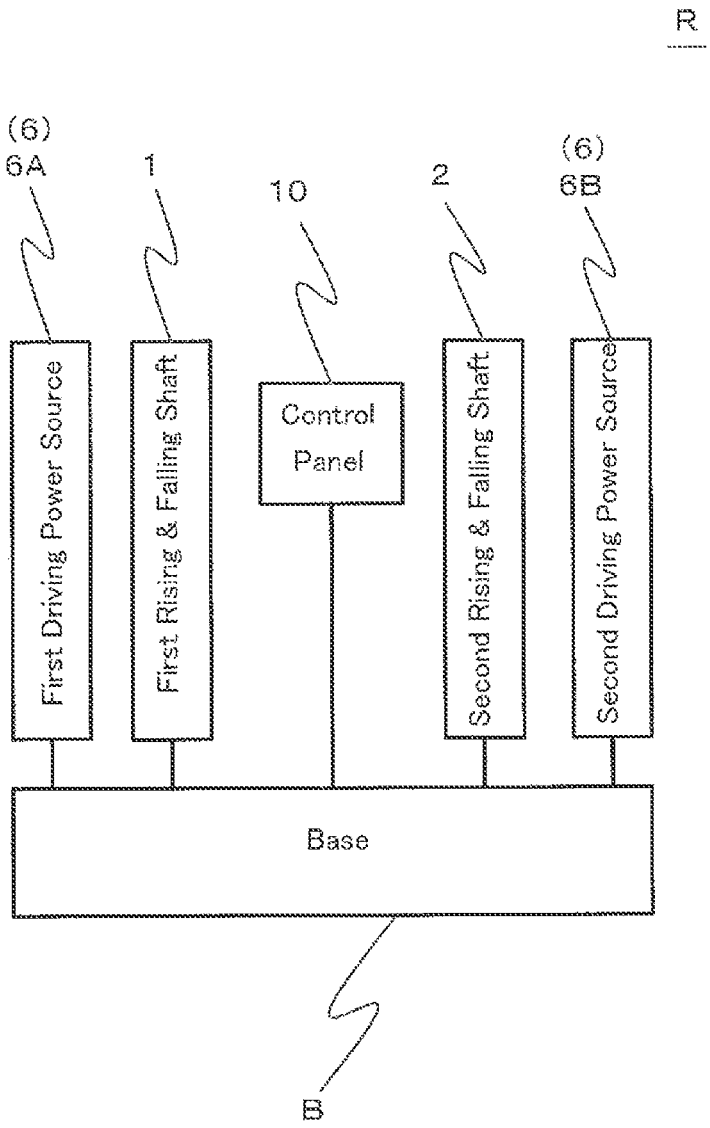
FIG. 3 is a schematic drawing of the care-robot.
Figure 4:
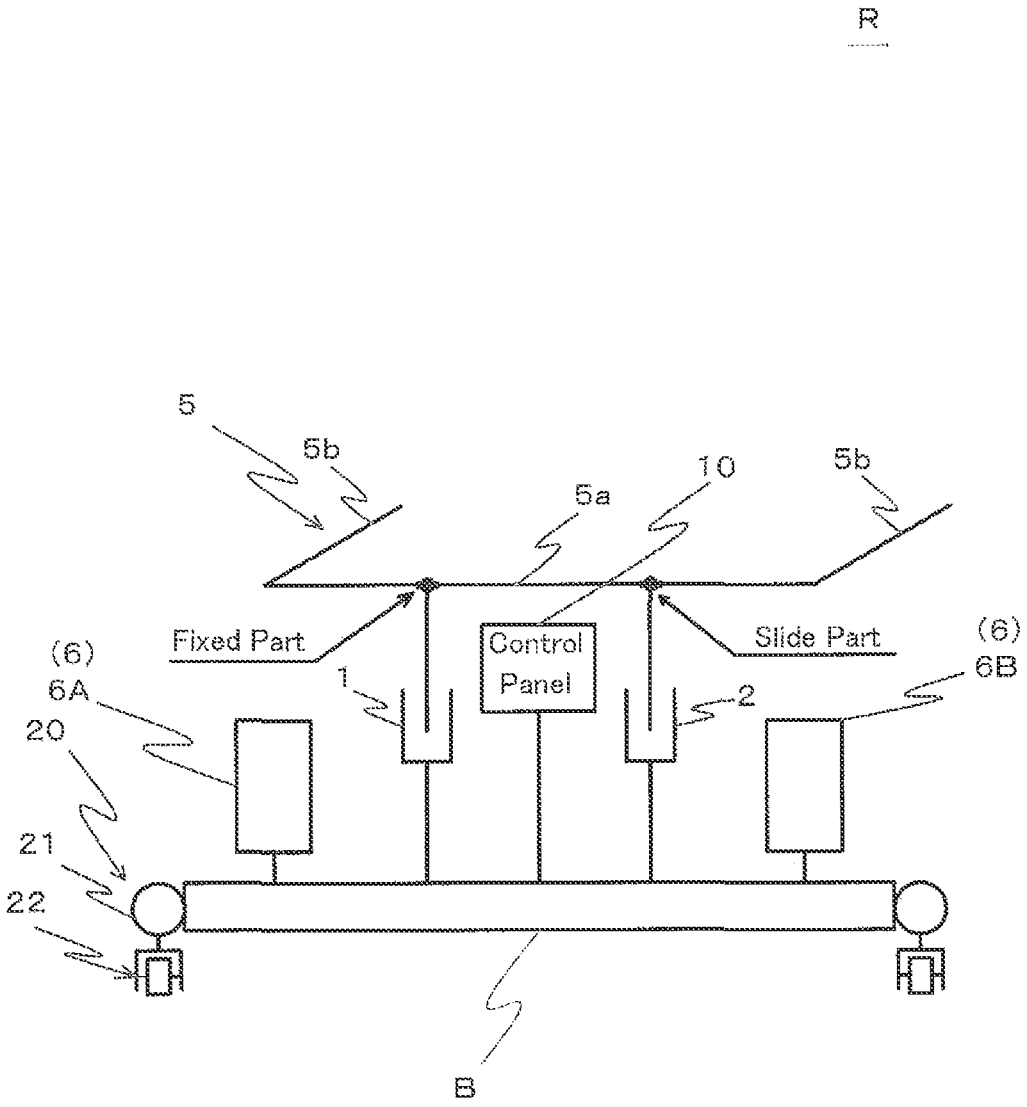
FIG. 4 is a schematic illustration of the care-robot.

As shown in FIG. 2 and FIG. 4, the base B is equipped with moving blocks 20, which are parallel to each other, at the both sides thereof, so that the base B is movable forward and backward. The moving block 20 includes a pipe 21, both ends of which are capped, and driving wheels 22 attached to both ends of the pipe 21.

Moreover, the wheels 22 may be rotatably attached to the pipe 21. Accordingly, the robot R is able to move right-wards and left-wards as well as forward and backward.

The first rising and falling shaft 1 and the second rising and falling shaft 2 are, for example, made of electric cylinders.

The U-formed element 5 includes bottom section 5*a* and arm sections 5*b* which project from the bottom section 5*a*. The bottom section 5*a* is held by the main rotative block 3 and the subordinate rotative block 4 as described above. The distance between the arm sections 5*b* is the same distance as the distance between holding parts 31 of custom care sheet 30 (Refer to FIG. 7).

Figure 5A:
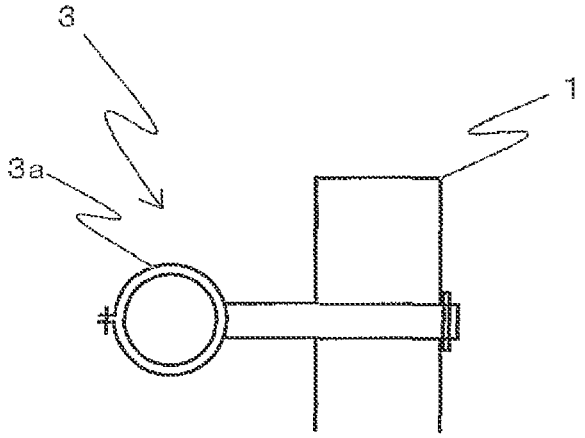
FIG. 5(*a*) is a schematic drawing of a holding part for a U-formed element showing a fixed part.
Figure 5:
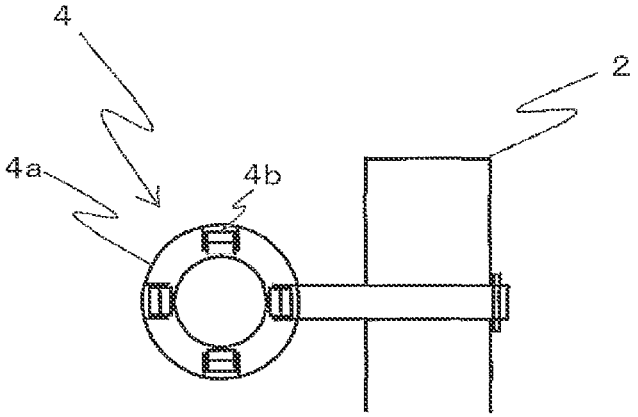

FIG. 5 shows one example of a fixed part and one example of a slide part. In the fixed part, the bottom section 5*a* is held by the grasping portion 3*a* of the main rotative block 3 attached to the top of the first rising and falling shaft 1 so as not to slide as shown in FIG. 5(*a*). On the other hand, in the slide portion, the bottom section 5*a* is inserted into the sliding portion 4*a* of the subordinate rotative block 4 attached to the top of the second rising and falling shaft 2 so as to slide as shown in FIG. 5(*b*). The drawing symbol 4*b* shows a roller bearing.

The driving power source 6 is, for example, a battery, and therefore the robot R can be made cordless. Also, the driving power source 6 includes a first driving power source 6A for driving the first rising and falling shaft 1 and a second driving power source 6B for driving the second rising and falling shaft 2, in which the first rising and falling shaft 1 and the first driving power source 6A are electrically connected, and the second rising and falling shaft 2 and the second driving power source 6B are electrically connected.

Figure 6:
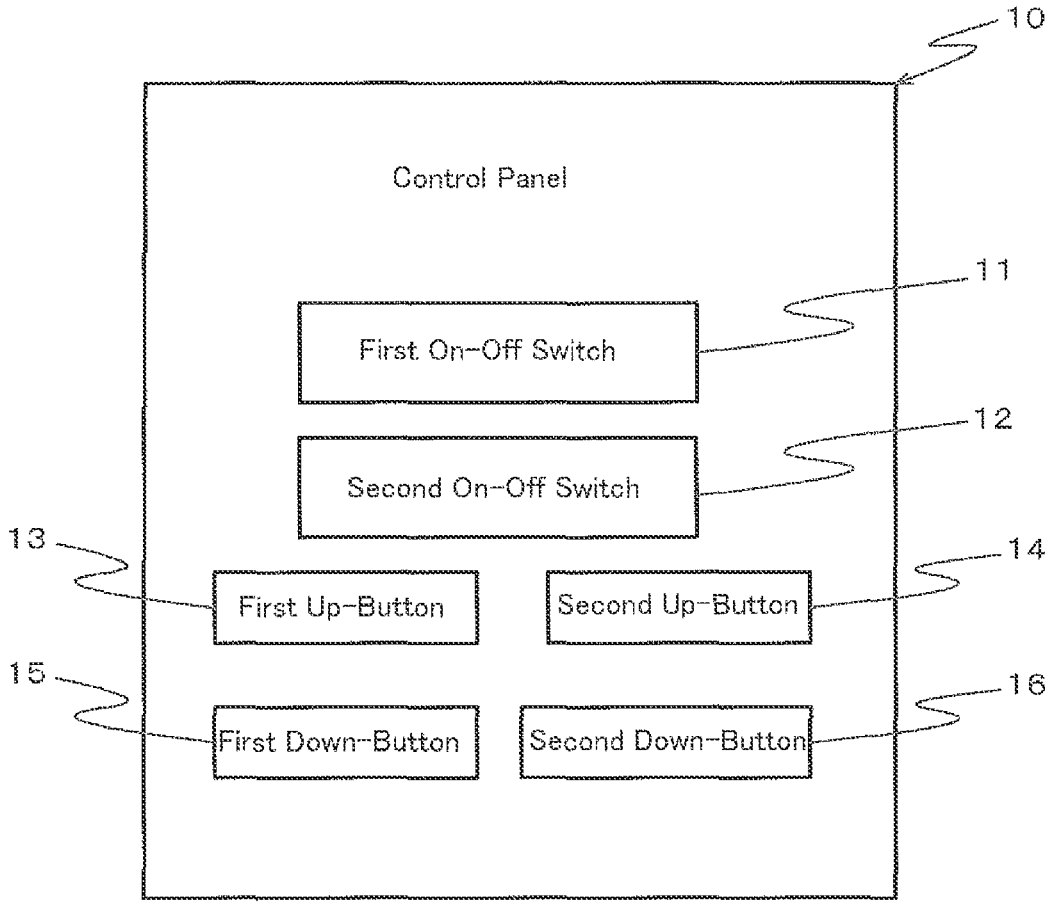
FIG. 6 is a schematic drawing of a control panel.

As shown in FIG. 6, the control panel 10 has a first on-off switch 11 for switching on-off the first driving power source 6A, a second on-off switch 12 for switching on-off the second driving power source 6B, a first up-button 13 for extending the first rising and falling shaft 1 upward, a first down-button 14 for shortening the first rising and falling shaft 1 downward, a second up-button 15 for extending the second rising and falling shaft 2 upward, and a second down-button 16 for shortening the second rising and falling shaft 2 downward. The control panel 10 is, for example, placed between and rearward of the first rising and falling shaft 1 and the second rising and falling shaft 2.

Figure 7A:
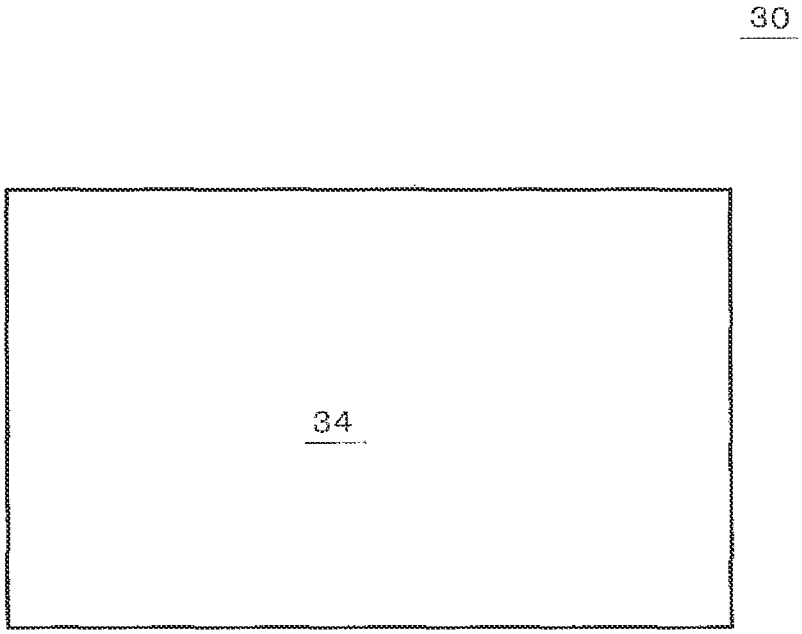
FIG. 7(*a*) is plan view of a custom care sheet.
Figure 7B:
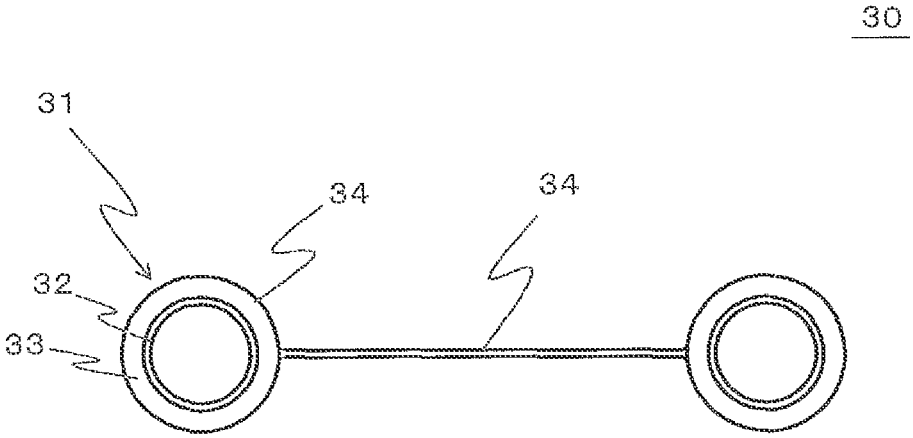

FIG. 7 shows one example of the custom care sheet 30.

As shown in FIG. 7, the custom care sheet 30 has cylindrical holding parts 31 at both ends thereof. The arm sections 5*b* of robot R are inserted into the cylindrical holding parts 31.

Each holding part 31 includes a base layer 32, a cushion layer 33 arranged outside the base layer 32, and a surface layer 34 made of synthetic resins sheet.

Next, transferring the care receiver by the robot R is described.

Step 11: Moving the robot R so that the arm sections 5*b* of the U-formed element 5 are positioned relative to the holding parts 31 of the custom care sheet 30. The robot R is positioned so that the first rising and falling shaft 1 is near the head of the care receiver.

Step 12: Pushing buttons on the control panel 10 to set both of the arm sections 5*b* at the level of the holding parts 31 of the custom care sheet 30 on which the care receiver is laid.

Step 13: Moving the robot R forward, inserting the arm sections 5*b* of the U-formed element 5 into the holding parts 31 formed at the both ends of the custom care sheet 30.

Step 14: Pushing the first up-button 13 and the second up-button 15, raising the arm sections 5*b* of the U-formed element 5 by the predetermined distance above the bed.

Step 15: Moving the robot R backward so that the robot R moves away from the bed. Namely, moving the care receiver beside the bed.

Step 16: Positioning the caregiver close to the feet of the care receiver, pushing the first up-button 13 properly so that the head of the care receiver is raised higher than the feet of the care receiver, and then holding the care receiver by the caregiver.

Step 17: The caregiver moves the care receiver, for example, to the wheelchair.

As is mentioned above, according to the robot R of the embodiment, it is not necessary for the caregiver to lift up the care receiver from the bed, so that the burden on the caregiver is reduced. For example, the back-ache, which is considered an occupational disorder of the caregiver, can be prevented.

Embodiment 2

A robot R of the embodiment 2 of the present invention is shown in FIG. 9 to FIG. 14.

As shown in FIG. 9 to FIG. 14, the robot R is constructed mainly from a movable base 100; a rising and falling shaft 51 attached to the movable base 100; a rotative shaft 52 arranged at the top of the rising and falling shaft 51; a first expanding and contracting shaft 53 and a second expanding and contracting shaft 54, which are arranged symmetrically with respect to the axis of the rotative shaft 52, at the ends of the rotative shaft 52; a stick-like first arm (right arm) 55 set, which is projected forward, at the end of the first expanding contracting shaft 53; a stick-like second arm (left arm) 56 set, which is projected forward, at the end of the second expanding and contracting shaft 54; a driving power source 57; and a control panel 70. The robot R is moved forward and backward by operating manual operating levers 74.

The base 100 includes a loading section 110 arranged at the center of the base 100, and moving sections 160 arranged at both ends of the loading section 110. More specifically, the loading section 110 includes a loading part 120 arranged at the center of the base 100, and horizontal support members 130 which are elongated rightward and leftward. The moving section 160 includes a front moving section 170 and a rear moving section 180. The front moving section 170 includes a front wheel 171 and a front wheel support block 172 supporting the front wheel 171. The rear moving section 180 includes a rear wheel 181 and a rear wheel support block 182 supporting the rear wheel 181. The front wheel support block 172 and the rear wheel support block 182 are connected to the horizontal support members 130 by suitable means. Here, the diameter of the front wheel 171 is smaller than that of the rear wheel 181.

The loading section 110 or more specifically the loading part 120, is equipped with the rising and falling shaft 51, the driving power source 57 and the control panel 70.

The front wheel support block 172 includes the front level part 173 and the upslope rear part 174. The front wheel 171 is attached to the end of the front level part 173. Since the diameter of the front wheel 171 is smaller than that of the rear wheel 181 and the front wheel support block 172 has such configuration, the front moving section 170 can be entered under the bed. The other parts of the front wheel support block 172 and the parts of the rear wheel support block 182 can be those well-known for a wheel support.

The rising and falling shaft 51 includes, for example, an electric cylinder.

The rotative shaft 52 includes, for example, an electric servomotor.

The first expanding and contracting shaft 53 and the second expanding and contracting shaft 54 include, for example, electric cylinders.

The driving power source 57 is, for example, a battery.

Figure 15:
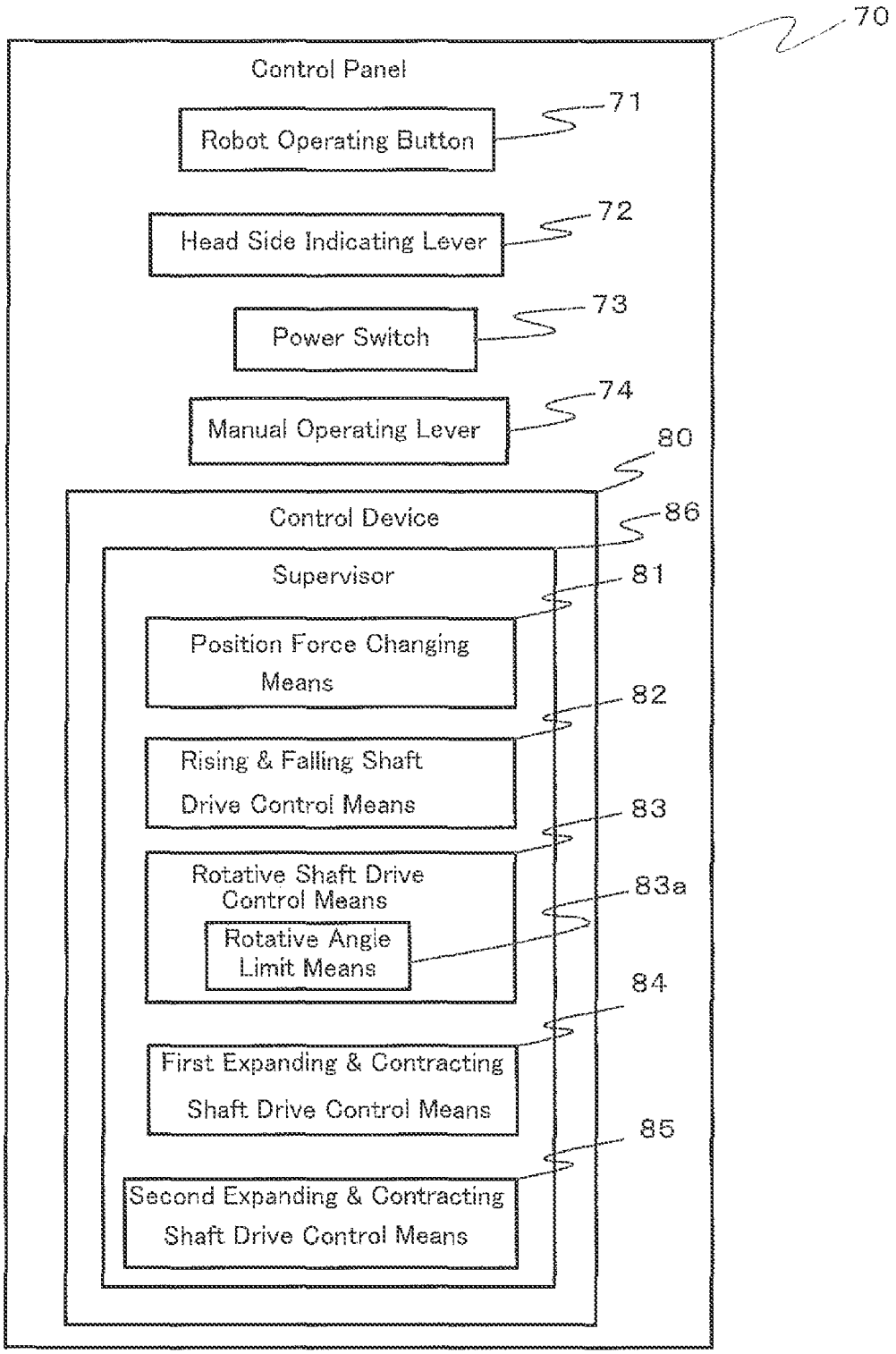
FIG. 15 is a schematic drawing of a control panel.

As shown in FIG. 15, the control panel 70 has robot operating buttons 71, a head side indicating lever 72 indicating whether the head of the care receiver is at the right-side of the robot R or at the left-side thereof, a power switch 73, a manual operating lever (manual operating means) 74, and a control device 80.

The robot operating buttons 71 are located at the end of the manual operating lever 74 arranged on the right-side cover CR covering the first expanding and contracting shaft 53 and at the end of the manual operating lever 74 arranged on the left-side cover CL covering the second expanding and contracting shaft 54, respectively. The robot R can be operated while both of the both operating buttons 71 are pushed as a fail-safe.

Figure 16:
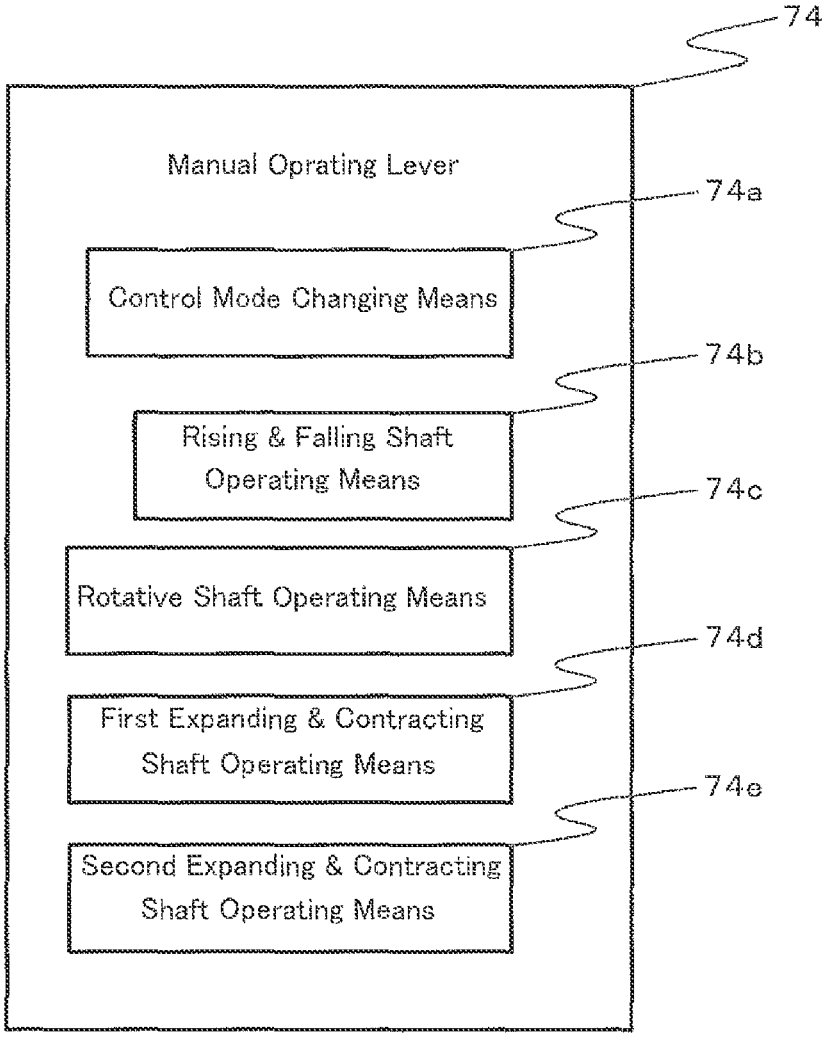
FIG. 16 is a schematic drawing of an operation lever.

As shown in FIG. 16, the manual operating lever 74 includes a control mode changing means 74*a*, which control position-force control changing means 81 which change over position-force control; a rising and falling shaft operating means 74*b* operating the rising and falling shaft 1; a rotative shaft operating means 74*c* operating the rotative shaft 2; a first expanding and contracting shaft operating means 74*d* operating the first expanding and contracting shaft 53; a second expanding and contracting operating means 74*e* operating the second expanding and contracting shaft 54. All the above means work by controlling the angle or inclination of the lever, The control device 80 has the position-force control changing means 81 changing position-force control, a rising and falling shaft drive control means 82 controlling drive of the rising and falling shaft 51, a rotative shaft drive control means 83 controlling drive of the rotative shaft 52, a first expanding and contracting shaft drive control means 84 controlling a drive of the first expanding and contracting shaft 53, a second expanding and contracting shaft drive control means 85 controlling a drive of the second and contracting shaft 54, a supervisor means 86 supervising all the above means. The supervisor means 86 supervises the means so that, for example, the rotative shaft 52 can rotate, the expanding and contracting shafts 53 and 54 can be extended or shortened, and the rising and falling shaft 51 can be extended upward or shortened downward in response to the signals from the robot operating buttons 71 when they are pushed.

The rotative shaft drive control means 83 has a rotative angle limit means 83*a* limiting a rotative angle of the rotative shaft 52 in response to signals from the head-side indicating lever 72. Here, the rotative angle limit means 83*a* controls the rotative angle so that the head of the care receiver is not positioned below the feet of the care receiver.

The control device 80 as described above can be made by installing programs carrying out said functions to a computer.

Hereinafter, moving a care receiver by the robot R having the above configuration is described.

Step 1: Moving the robot R so that the robot R faces the care receiver laid on the custom care sheet 30.

Step 2: Pushing the robot operating buttons 71 and operating the levers to actuate the rising and falling operating means 74*b* and operate the rising and falling shaft 51, so that the right arm 55 and the left arm 56 are positioned at the level of the holding parts 31 of the custom care sheet 30.

Step 3: Pushing the robot operating buttons 71 and operating the levers to actuate the first expanding and contracting shaft operating means 74*d* and the second expanding and contracting shaft operating means 74*e* and operate the first expanding and contracting shaft 53 and the second expanding and contracting shaft 54, so that the right arm 55 and the left arm 56 are positioned to face the holding parts 31.

Step 4: Moving the robot R forward to insert the right arm 55 and the left arm 56 into the holding parts 31 of the custom care sheet 30.

Step 5: Indicating the head side of the care receiver by the head side indicating lever. Namely, indicating whether the head of the care receiver is at the right side of the robot R or on the left side thereof.

Step 8: Pushing the robot operating buttons 71 and operating the levers to actuate the rising and falling operating means 74*b* and operate the rising and falling shaft 51, so that the custom care sheet 30 are raised by a predetermined distance above the bed. Namely, the care receiver is raised from the bed.

Step 9: Pushing the robot operating buttons 71 and operating the levers to actuate the control mode changing means 74*a*, so that the control mode of the robot R is changed from position control to force control.

Step 10: Moving the robot R backward, so that the care receiver is moved away from the bed.

Step 11: Pushing the robot operating buttons 71 and operating the levers to actuate the control mode changing means 74*a*, so that the control mode of the robot R is changed from the force control to the position control.

Step 12: Pushing the robot operating buttons 71 and operating the levers to actuate the rotative shaft operating means 74*c*, so that the head-level of the care receiver is higher than the foot-level thereof.

Step 13: Pushing the robot operating buttons 71 and operating the levers to actuate the control mode changing means 74*a*, so that the control mode of the robot R is changed from the position control to the force control.

After the posture of the care receiver is positioned as described above, a caregiver moves the care receiver to a wheelchair.

As is mentioned above, according to the robot R of the embodiment, it is not necessary for the caregiver to raise the care receiver from the bed. Accordingly, the burden on the caregiver is reduced. For example, the back-ache, which is considered an occupational disorder of the caregiver, is alleviated.

Embodiment 3

Figure 17:
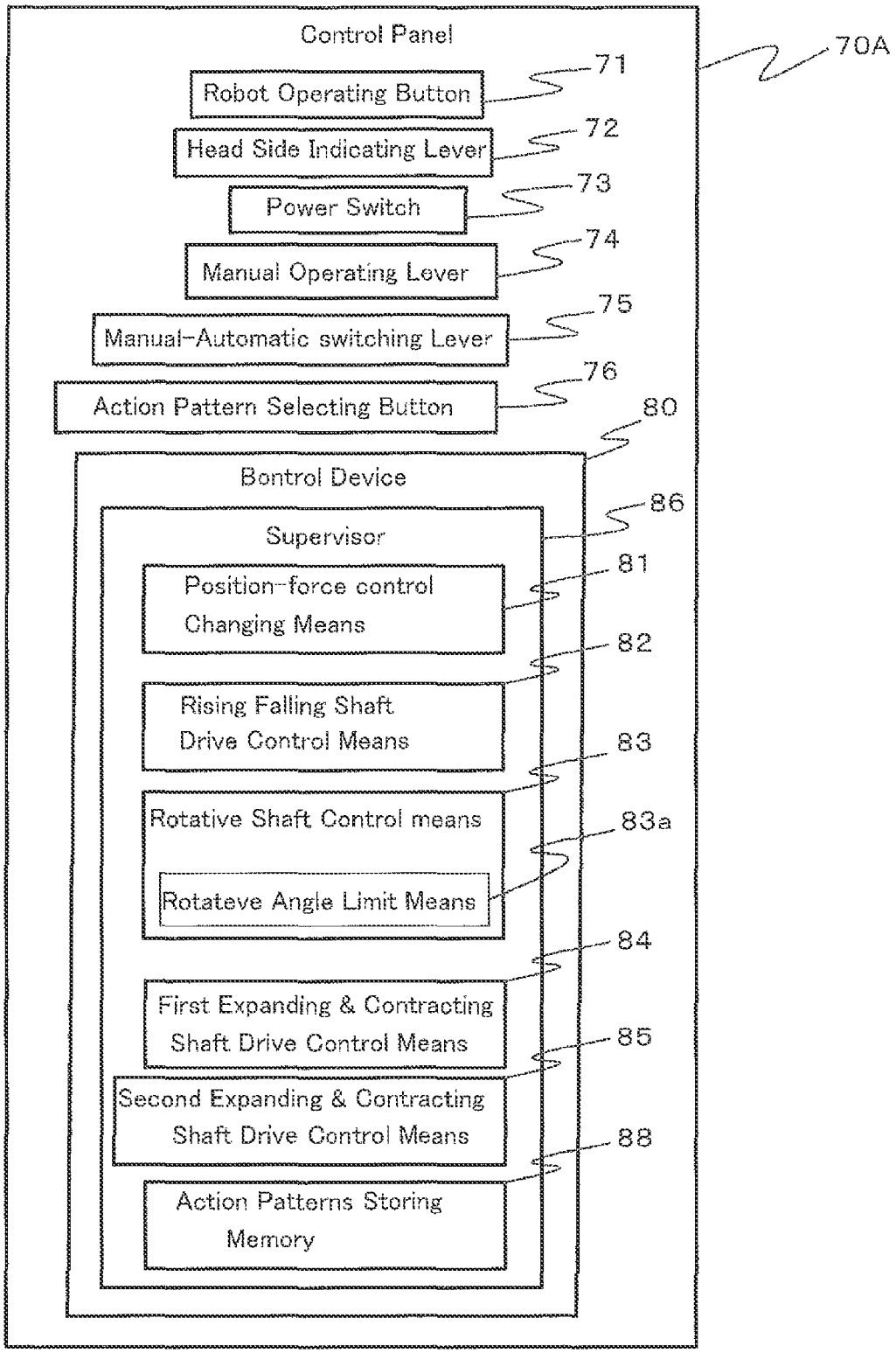
FIG. 17 is a schematic drawing of a control panel of the third embodiment of the care-robot of the present invention.

A control panel of the embodiment 3 of the robot of the present invention is shown in FIG. 17. Embodiment 3 is a modification of embodiment 2. In embodiment 3, the robot R is designed to be operated by either manual operation or automatic operation.

Namely, as shown in FIG. 17, the control panel 70A is additionally equipped with a manual-automatic switching lever (manual-automatic switching means) 75 and action pattern selecting button (action pattern selecting means) 76 at the control panel 70 of the embodiment 2, and is additionally equipped with an action patterns storing memory 88 at the control device 80 of the embodiment 2.

Hereinafter, the automatic operation is described.

The manual-automatic switching lever 75 is operated to choose the automatic operation, and one of the automatic action pattern selecting buttons 76 is pushed in order to select one automatic action pattern. Then the selected pattern stored in the operating patterns storing memory 88 is called, so that the robot R acts in accordance with the pattern. For example, while the rotative shaft 52 is rotated, the first expanding and contracting shaft 53 is properly extended and then shortened by driving the first expanding and contracting shaft 53, and the second expanding and contracting shaft 54 is properly extended and then shortened by driving the second expanding and contracting shaft 54.

Figure 18:
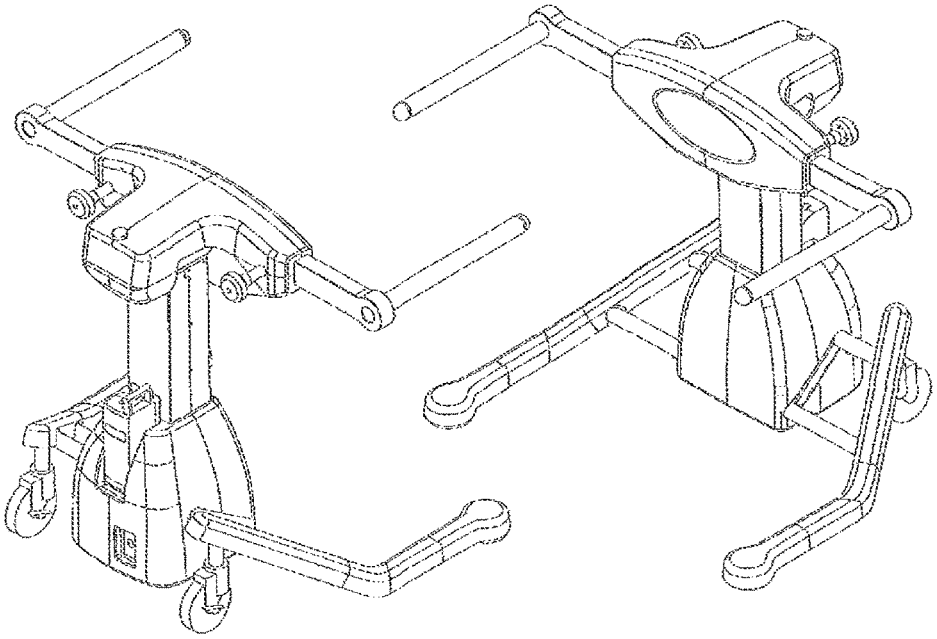
FIG. 18 is an explanatory illustration showing two care-robots with decorative covers facing each other, which are automatically operated.

Since the robot R is operated as described above, it appears that the robot R is dancing so that a healing effect is given to the care receiver. In order to enhance the healing effect, it is preferable that the robot R is covered with a decorative cover. FIG. 18 shows that two robots R with decorative covers, which face each other, are automatically operated.

As a result, the care receiver has an impression that the robots R are dancing, so that the healing effect for the care receiver is increased.

As described above, according to this embodiment, the robot R is automatically operated in accordance with the pre-setting pattern, so that the care receiver has an impression that the robots R are dancing. As a result, the healing effect for the care receiver is increased.

The present invention is described referring to specific embodiments. However, the scope of the invention is not intended limited to the specific embodiments, and numerous variants are possible.

Figure 8:
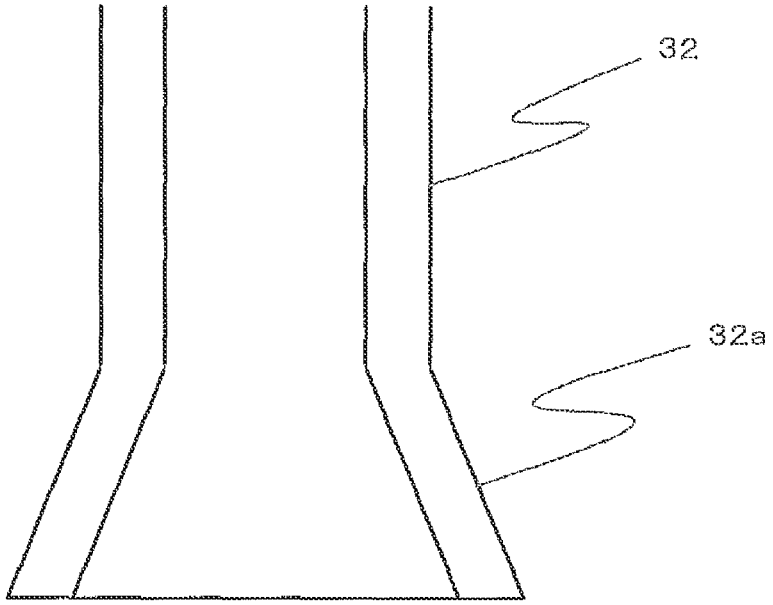
FIG. 8 is a rough sectional view of a modified holding part of the custom care sheet.
Figure 9:
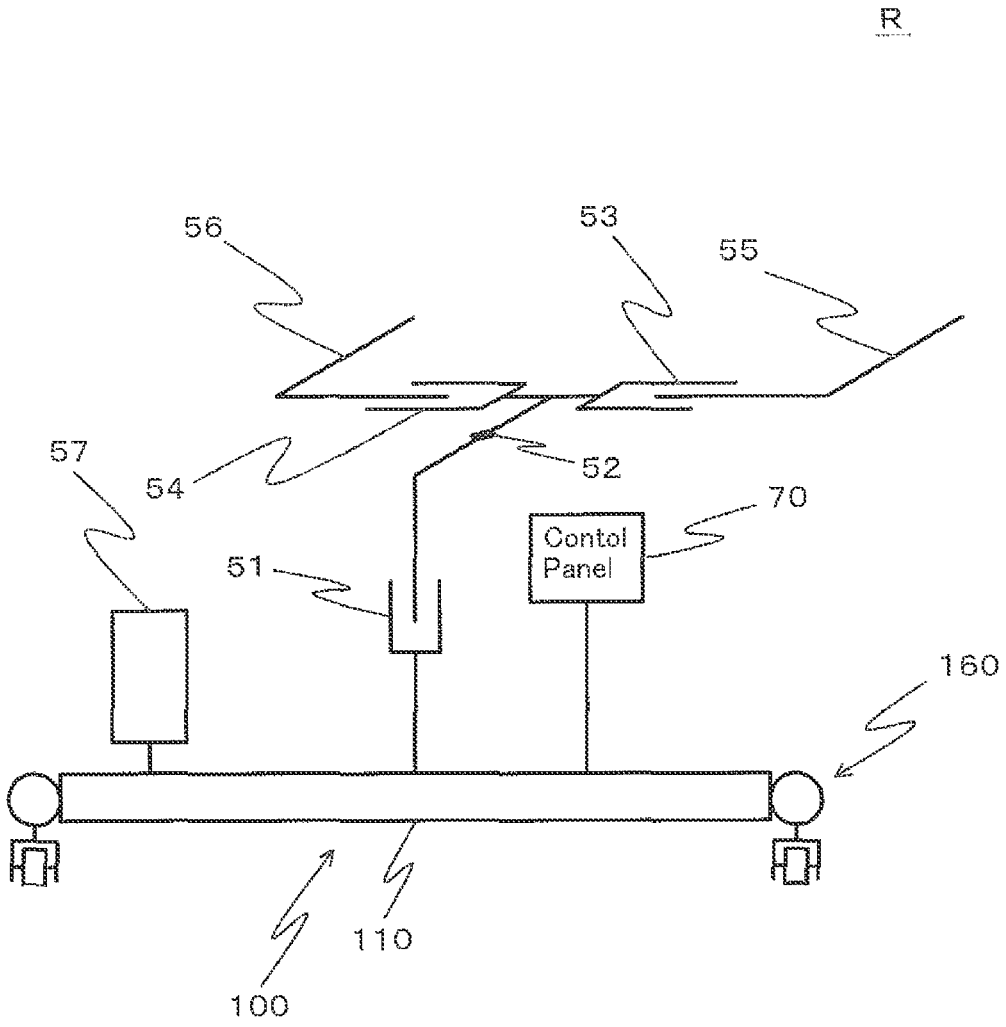
FIG. 9 is a schematic drawing of the second embodiment of the care-robot of the present invention.
Figure 10:
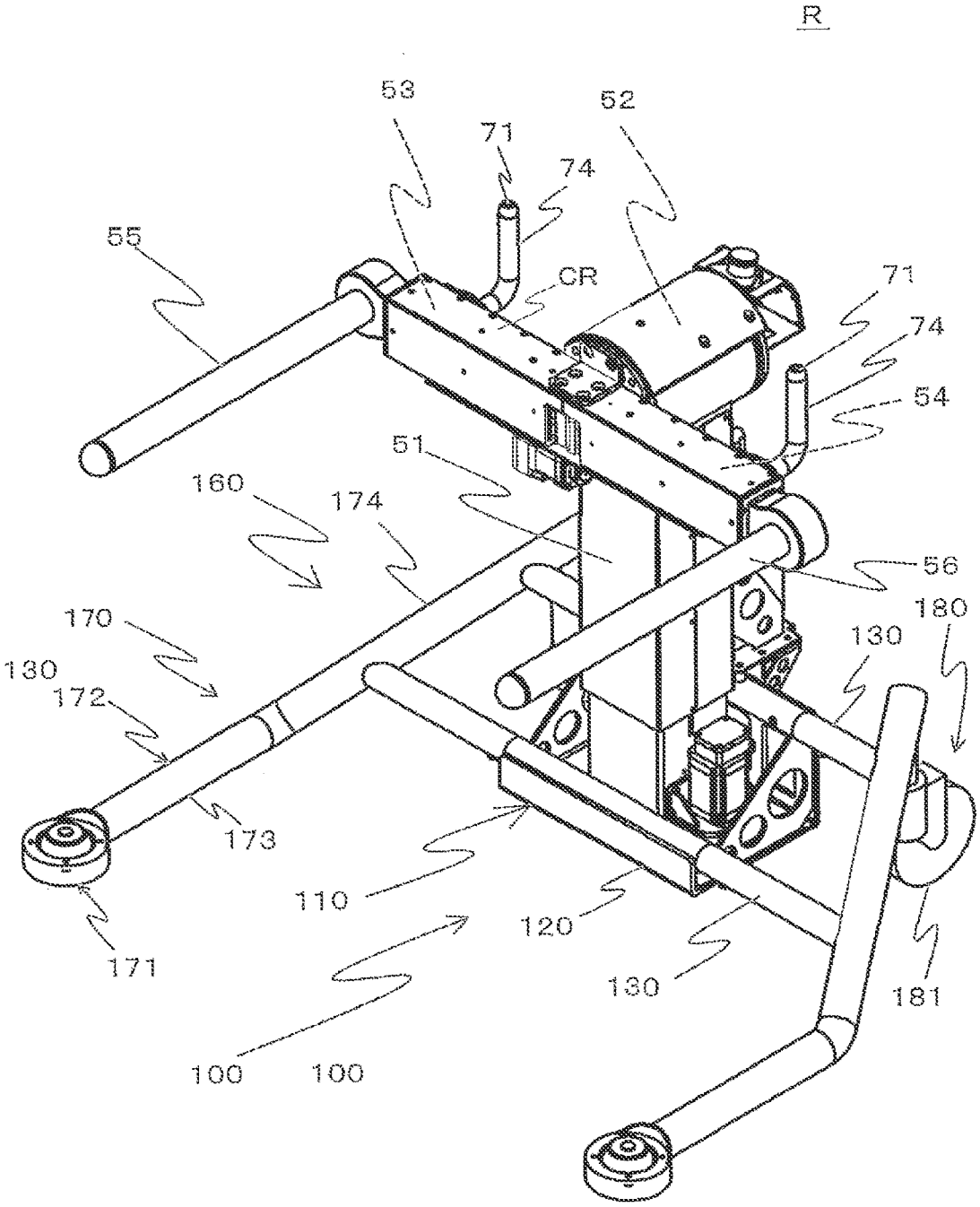
FIG. 10 is a perspective view of the care-robot.
Figure 11:
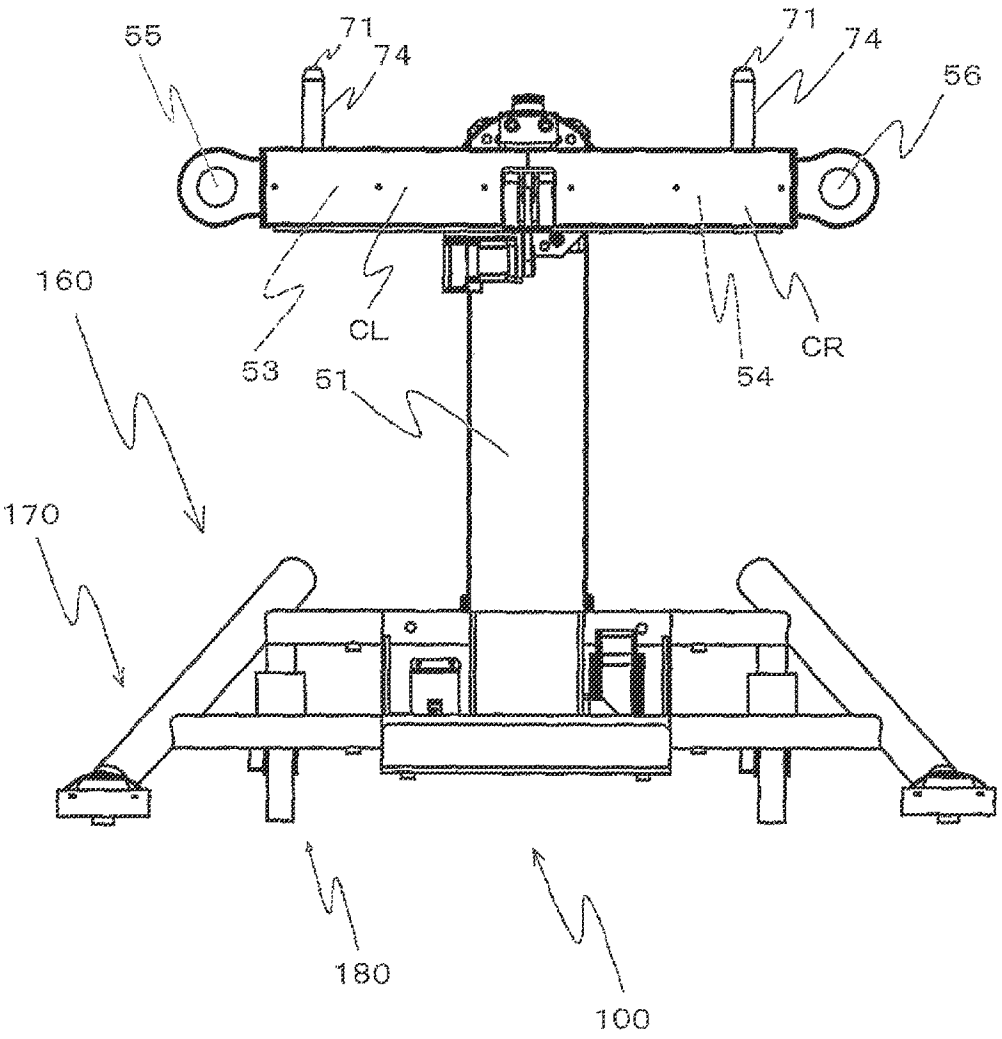
FIG. 11 is a front view of the care-robot.
Figure 12:
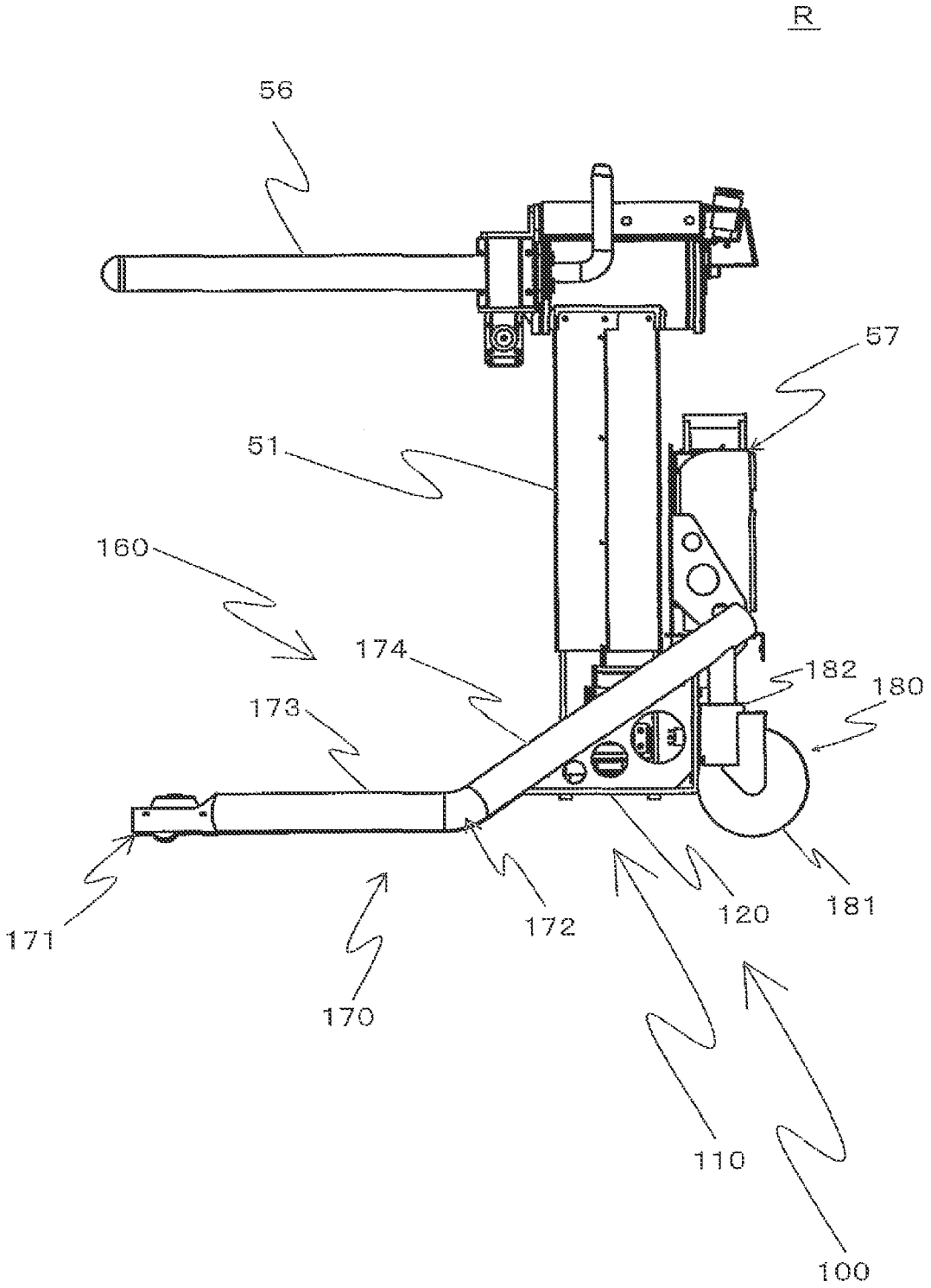
FIG. 12 is a right-side view of the care-robot.
Figure 13:
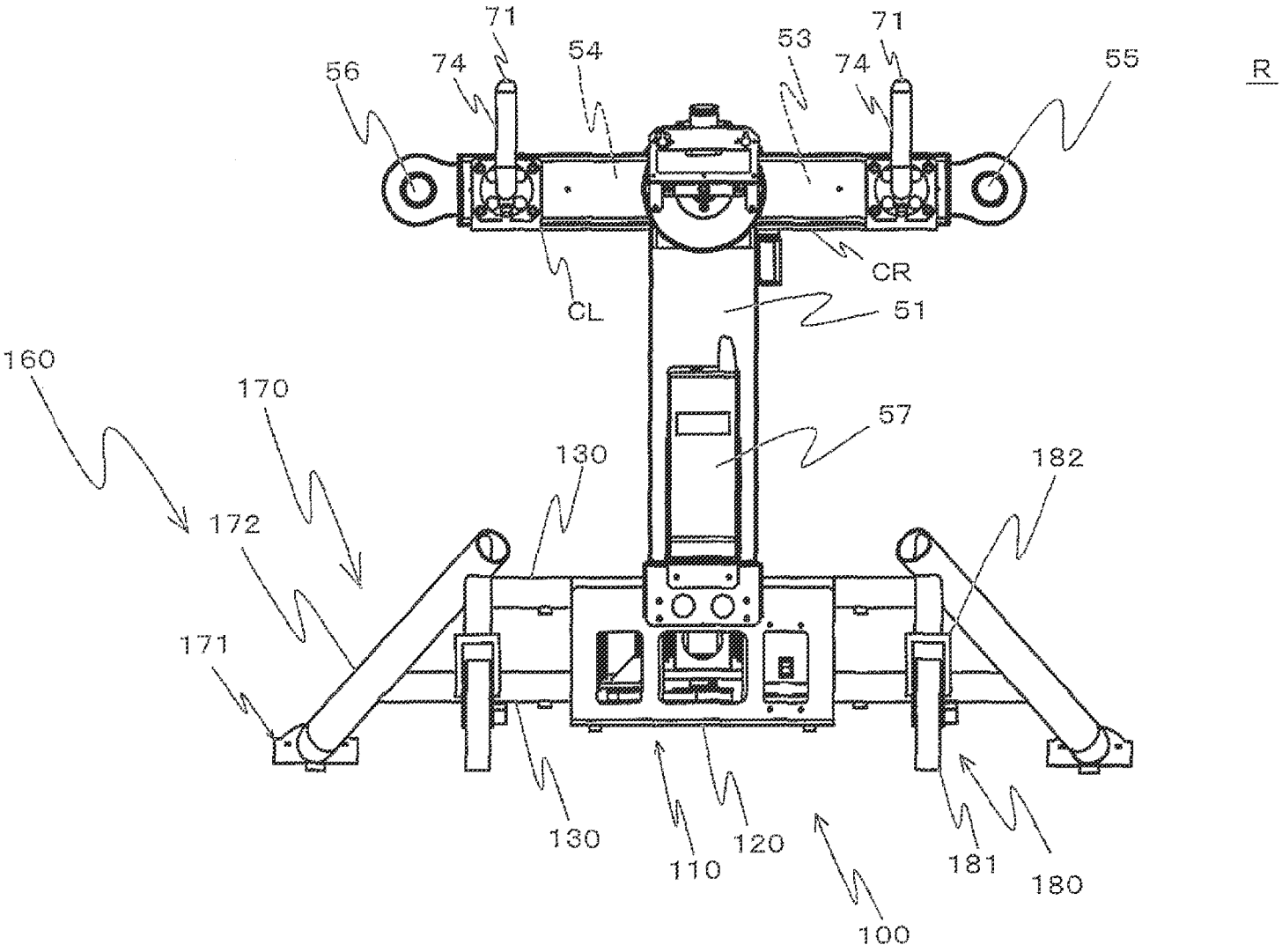
FIG. 13 is a rear view of the care-robot.
Figure 14:
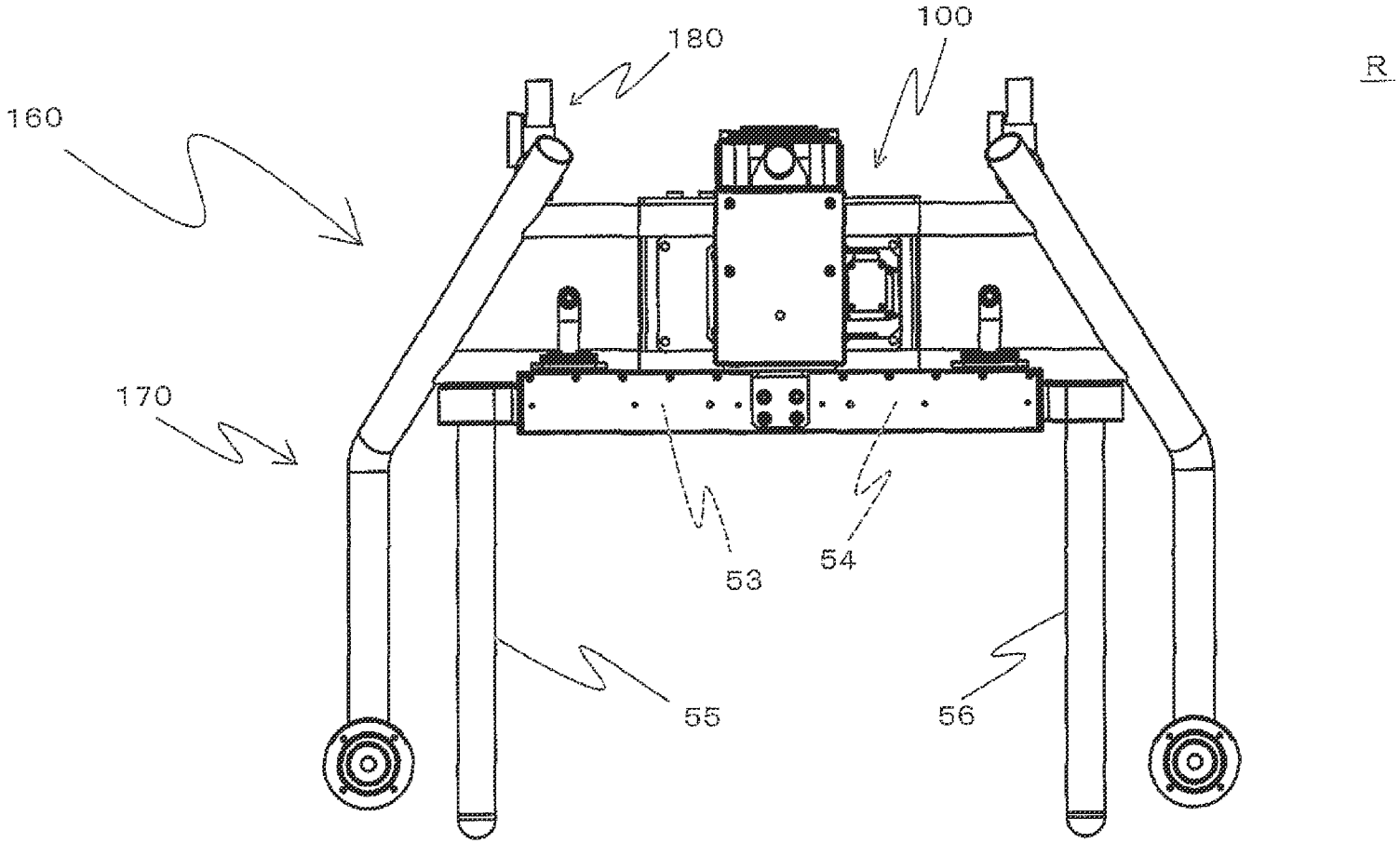
FIG. 14 is a bottom view of the care-robot.

For example, as shown in FIG. 8, a horn-like guiding portion 32*a* may be formed at the holding part 31 of the custom care sheet 30, into which the robot arm 5*b* of the robot R is inserted.

Also, in the above embodiment, electric power is supplied from the battery equipped on the robot R. However, electric power may be supplied from a commercial power source.

The present invention is applicable for use in the robot industry and the care business.

SYMBOL

B Base
R Robot
CR Right-side cover
CL Left-side cover
1 First rising and falling shaft
2 Second rising and falling shaft
3 Main rotative block
3*a* Grasping portion
4 Subordinate rotative block
4*a* Sliding portion
4*b* Roller bearing
5 U-formed element
5*a* Bottom section
5*b* Arm section
6 Diving power source
10 Control panel
11 First on-off switch
12 Second on-off switch
13 First up-button
14 First down-button
15 Second up-button
16 Second down button
20 Moving block
21 Pipe
22 Driving wheel
30 Custom care sheet
31 Holding part
32 Base layer
32*a* Guiding portion
33 Cushion layer
34 Surface layer
51 Rising and falling shaft
52 Rotative shaft
53 First expanding and contracting shaft
54 Second expanding and contracting shaft
55 First arm, Right arm
56 Second arm, Left arm
57 Driving power source
70 Control panel
70A Control panel
71 Robot operating button
72 Head side indicating lever
73 Power switch
74 Manual operating lever
74*a* Control mode changing means
74*b* Rising and falling shaft operating means
74*c* Rotative shaft operating means
74*d* First expanding and contracting shaft operating means
74*e* Second expanding and contracting shaft operating means
75 Manual-automatic switching lever
76 Action pattern selecting button
80 Control device
81 Position-force control changing means
82 Rising and falling shaft drive control means
83 Rotative shaft drive control means
83*a* Rotative angle limit means
84 First expanding and contracting shaft drive control means
85 Second expanding and contracting shaft drive control means
86 Supervisor
88 Operating patterns storing memory
100 Base
110 Loading section
120 Loading part
130 Horizontal support member
160 Moving section
170 Front moving section
171 Front wheel
172 Front wheel support block
173 Front level part
174 Upslope rear part
180 Rear moving section
181 Rear wheel
182 Rear wheel support block

We claim:

1. A method for lifting and moving a care receiver from a bed using a robot and a sheet wherein, the robot has, a rotative shaft having an axis, a first expanding and contracting shaft disposed radially with respect to the axis and operated by a first expanding and contracting shaft operating means, a second expanding and contracting shaft disposed radially with respect to the axis and operated a second expanding and contracting shaft operating means, wherein the first and second expanding and contracting shafts are symmetrical with respect to the axis, a first longitudinal arm projected forward from a first end of the first expanding and contracting shaft, and a second longitudinal arm projected forward from a second end of the second expanding and contracting shalt, and the sheet has a first longitudinal hollow holding part adapted for insertion of the first longitudinal arm of the robot thereto, and a second longitudinal hollow holding part adapted for insertion of the second longitudinal arm of the robot thereto, the method comprising:

spreading out the sheet on top of a bed;

laying the care receiver on the sheet, wherein the head of the care receiver is put the first longitudinal hollow holding part, the knees of the care receiver are put on the second longitudinal hollow holding part and the back and the hip of the care receiver are put on the sheet;

positioning the robot and the first and second arms thereof relative to the care receiver;

moving the robot towards one side of the bed;

positioning the first and second arms of the robot at the level of the first and second longitudinal hollow holding parts of the sheet;

positioning the first arm of the robot to the first longitudinal hollow holding part and the second am of the robot to the second longitudinal hollow holding part by operation of the first expanding and contracting shaft and the second expanding and contracting shaft respectively;

inserting the first longitudinal arm into the first longitudinal hollow holding part and the second longitudinal arm into the second longitudinal hollow holding part respectively;

moving the first and second arms upward to a predetermined distance so the care receiver is lifted above the bed;

moving the robot away from the bed after the step of moving the first and second arms upward; and positioning a head level of the care receiver higher than a foot level thereof by rotating the rotative shaft.

* * * * *